US010677393B2

(12) United States Patent
Matos

(10) Patent No.: US 10,677,393 B2
(45) **Date of Patent: *Jun. 9, 2020**

(54) FROZEN/CHILLED FLUID FOR PIPELINES AND FOR STORAGE FACILITIES

(71) Applicant: Jeffrey A. Matos, New Rochelle, NY (US)

(72) Inventor: Jeffrey A. Matos, New Rochelle, NY (US)

( * ) Notice: Subject to any disclaimer, the term of this patent is extended or adjusted under 35 U.S.C. 154(b) by 98 days.

This patent is subject to a terminal disclaimer.

(21) Appl. No.: 15/953,692

(22) Filed: Apr. 16, 2018

(65) Prior Publication Data

US 2018/0252368 A1 Sep. 6, 2018

Related U.S. Application Data

(60) Continuation of application No. 14/791,875, filed on Jul. 6, 2015, now Pat. No. 9,951,908, which is a division of application No. 13/454,309, filed on Apr. 24, 2012, now Pat. No. 9,074,732, which is a division of application No. 12/156,747, filed on Jun. 4, 2008, now Pat. No. 8,161,998.

(60) Provisional application No. 60/933,033, filed on Jun. 4, 2007.

(51) Int. Cl.
*F17D 3/00* (2006.01)
*F17D 1/08* (2006.01)

(52) U.S. Cl.
CPC ..... *F17D 3/00* (2013.01); *F17D 1/086* (2013.01); *Y10T 137/0318* (2015.04); *Y10T 137/0324* (2015.04); *Y10T 137/4757* (2015.04); *Y10T 137/5515* (2015.04); *Y10T 137/6416* (2015.04); *Y10T 137/7303* (2015.04); *Y10T 137/7737* (2015.04); *Y10T 137/7761* (2015.04); *Y10T 137/85978* (2015.04); *Y10T 137/86196* (2015.04); *Y10T 137/87917* (2015.04)

(58) Field of Classification Search
CPC ..... Y10T 137/7303; Y10T 137/0318; Y10T 137/0324; Y10T 137/4757; Y10T 137/5515; Y10T 137/6416; Y10T 137/7737; Y10T 137/7761; Y10T 137/85978; Y10T 137/86196; Y10T 137/87917; F17D 1/086; F17D 3/00
USPC ... 137/334, 468, 487.5, 565.01, 565.11, 572, 137/613, 614
See application file for complete search history.

(56) References Cited

U.S. PATENT DOCUMENTS

| | | | | |
|---|---|---|---|---|
| 3,438,743 | A | 4/1969 | Steijner | B01F 7/00125 137/4 |
| 4,958,653 | A * | 9/1990 | Lowther | C09K 3/00 137/13 |
| 5,261,243 | A | 11/1993 | Dunsmore | F25D 3/10 62/223 |
| 6,217,626 | B1 * | 4/2001 | Morris | C10L 3/06 48/190 |
| 6,703,534 | B2 | 3/2004 | Waycuilis et al. | 585/15 |
| 7,171,814 | B2 | 2/2007 | Ingham | F17C 9/00 62/50.1 |

(Continued)

*Primary Examiner* — William M McCalister
(74) *Attorney, Agent, or Firm* — Robert W. Morris; Eckert Seamans Cherin & Mellott LLC

(57) ABSTRACT

Methods for managing a hazardous fluid within a pipeline and within a storage facility, and in particular for managing a potential or actual leak of the hazardous fluid. Such methods include the detection of such an event by one or more sensors, and the containment and the mitigation of the event.

19 Claims, 6 Drawing Sheets

(56) References Cited

U.S. PATENT DOCUMENTS

| | | | | |
|---|---|---|---|---|
| 7,517,391 | B2 * | 4/2009 | Hall | B63B 25/12 95/231 |
| 7,546,873 | B2 | 6/2009 | Kim | C07C 4/02 166/242.1 |
| 7,607,310 | B2 * | 10/2009 | Morris | F17C 11/007 62/46.1 |
| 8,070,459 | B2 * | 12/2011 | Tollner | G05D 16/208 417/53 |
| 8,281,861 | B2 | 10/2012 | Nguyen | E21B 43/2401 165/45 |
| 2004/0261857 | A1 | 12/2004 | Webster | 137/487.5 |
| 2005/0199286 | A1 | 9/2005 | Appleford et al. | 137/487.5 |
| 2008/0000529 | A1 | 1/2008 | Lawrence Edwards | 137/465 |

* cited by examiner

FROZEN/CHILLED FLUID FOR PIPELINES AND FOR STORAGE FACILITIES

CROSS-REFERENCE TO RELATED APPLICATION

This application claims priority from U.S. Provisional Patent Application No. 60/933,033, filed Jun. 4, 2007; U.S. patent application Ser. No. 12/156,747, filed. Jun. 4, 2008 (now U.S. Pat. No. 8,161,998); U.S. patent application Ser. No. 13/454,309, filed Apr. 24, 2012 (now U.S. Pat. No. 9,074,732); and U.S. patent application Ser. No. 14/791,875, filed. Jul. 7, 2015 (now allowed). This application is a continuation of each of the three aforesaid patent applications. The subject matter of this application is also related to that of U.S. Provisional Patent Application No. 60/331,881, filed Nov. 21, 2001; U.S. patent application Ser. No. 10/302,260, filed Nov. 21, 2002 (now U.S. Pat. No. 7,222,821); U.S. patent application Ser. No. 11/318,180, filed Dec. 24, 2005 (now Publication No. US 2006-0145011 A1); U.S. patent application Ser. No. 11/805,963 filed May 25, 2007 (now U.S. Pat. No. 8,042,771); and U.S. patent application Ser. No. 13/279,422, filed Oct. 24, 2011 (now Publication No. US 2012-0037758 A1). The subject matters of these patents and patent applications are incorporated herein by reference.

BACKGROUND OF THE INVENTION

The storage and transport of hazardous fluid substances poses challenges because of potential or actual damage to persons, equipment or the environment. Fluid substances pose a greater risk than solid ones, because a fluid, whether liquid or gas, is likely to disseminate more rapidly than a solid. Furthermore, if the fluid is a fuel or potential fuel, the failure to contain the fluid (whether intentional or accidental), may lead to detonation or ignition, resulting in explosion or fire.

The act of freezing a hazardous fluid fuel, thereby to render it a solid fuel, is known to increase the stability of the fuel, reducing the risk of fire and/or explosion; Chilling a fuel may have a similar effect. Freezing a hazardous substance will make it easier to contain in the event of a breach of the container. To the extent that chilling a hazardous substance increases its viscosity/decreases its fluidity, the chilling process will lessen the consequences of a breach of the substance container, by decreasing the rate at which the substance emerges from the compromised container.

SUMMARY OF THE INVENTION

Hereinbelow, the term "hazardous substance" is intended to include both the fluid state of the substance (whether liquid or gas), and the solid state of the substance.

The purpose of the invention described herein, is to minimize the risk posed by a hazardous fluid, during storage or transport of the fluid, by freezing or chilling the fluid.

The risk posed by the fluid may entail:

a) risk to persons, equipment or the environment in the vicinity of the pipeline or storage facility, because of toxic effects of the fluid;

b) risk to persons, equipment or the environment not in the vicinity of the pipeline or storage facility, because of wide ranging toxic effects of even very small amounts of the fluid; and c) risks to persons, equipment, the environment, the pipeline or storage facility itself, one or more adjacent pipelines or storage facilities, or the contents of the pipeline; because of blast, heat, or fire which may result from ignition or explosion of a substance within a pipeline or storage facility.

In one embodiment of the invention, the fluid is a fuel. The use of chilled and/or frozen fuel may:

1) minimize the risk of a terrorist action on a fuel pipeline or fuel storage depot; and 2) minimize the risk, in the event of an accidental breach of the pipeline, resulting in a leak.

In another embodiment of the invention, the fluid may be a toxic chemical, or a radioactive substance.

Embodiments of the invention are described in which the toxicity of a hazardous fluid is minimized (i) by chilling the fluid, and (ii) by freezing the fluid.

Embodiments of the invention are described in which the propulsive device which causes movement of a frozen hazardous substance through a pipeline is (i) largely within a pipeline; and (ii) largely outside of the pipeline.

Embodiments of the invention are described in which an emergency condition—e.g. in which the pipeline or storage facility is subject to a breach, fire, explosion, etc—is dealt with by isolating the compromised storage facility or segment of pipeline by closing one or more valves. The valves may be controlled locally or from a remotely located station.

Embodiments of the invention are described in which an emergency condition—e.g. in which a pipeline or storage facility containing a hazardous fluid is subject to a breach, fire, explosion, etc—is dealt with by rapidly freezing the fluid. The rapid freezing process is accomplished by rapidly dumping or injecting an extremely cold substance. Valves to control the release of the cold substance may be controlled locally or from a remotely located station.

DETAILED DESCRIPTION OF THE PREFERRED EMBODIMENTS

Figure 1:
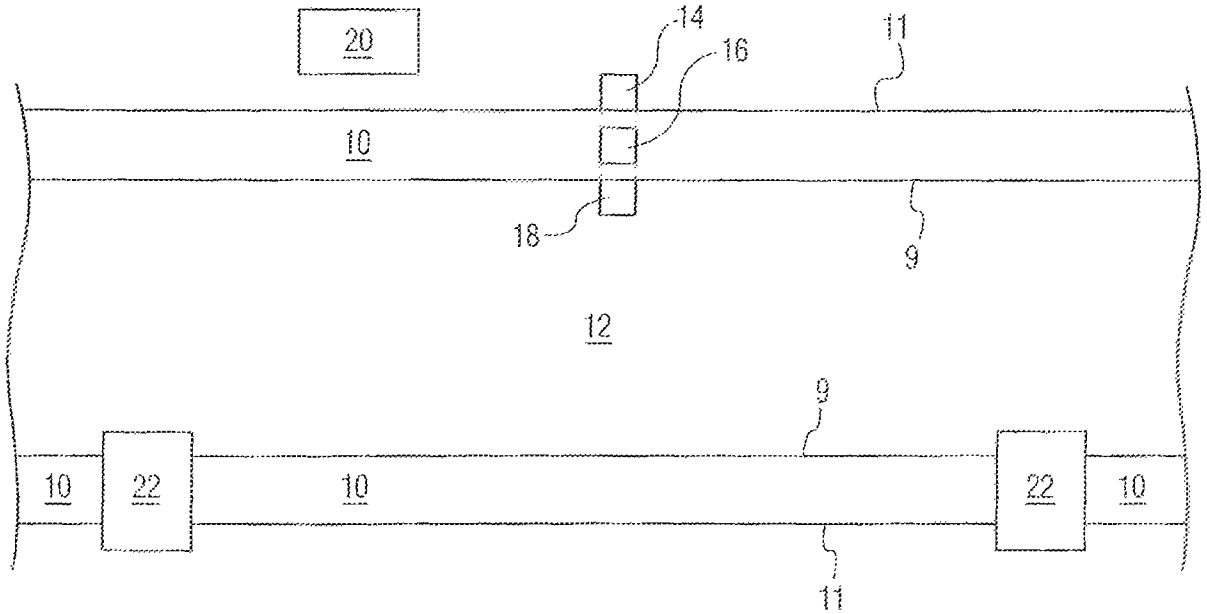
FIG. 1 is a representational diagram of a pipeline for carrying hazardous substances and of a storage facility for storing hazardous substances, with cooling apparatus and a control system for the cooling apparatus.

In the specification hereinbelow, the word "fuel" is intended to refer to any hazardous fluid.

Pipelines:

Methods of handling fuel in a pipeline to decrease the risk of fire, explosion, detonation, ignition or leakage—whether accidental or intentional—include:

I) Using Chilled Fuel:

A) at a cold temperature, not specified;

B) at a cold temperature in the range of pour point to a specified value above the pour point, e.g.:

1) a temperature ranging from approximately the pour point to 10 degrees C. above the pour point;

2) a temperature ranging from approximately the pour point to 20 degrees C. above the pour point;

3) a temperature ranging from approxima pour point to 25 degrees C. above the pour point;

4) a temperature ranging from approximately the pour point to 30 degrees C. above the pour point.

The temperature along the length of the pipeline may be relatively constant, or may vary within any of the ranges described hereinabove, or within another range.

II) Using Frozen Fuel:

The temperature may range:

A) from the pour point down to the temperature at which substantially all of the fuel is no longer a liquid;

B) from the pour point down to an unspecified temperature;

C) from the pour point down to a specific temperature; e.g.

1) 20 degrees C. below the pour point;

2) 30 degrees C. below the pour point, etc.

The temperature along the length of the pipeline may be relatively constant, or may vary within any of the ranges described hereinabove, or within another range.

Fuel may be inserted into the pipeline:

A) already frozen;

B) as a liquid, to then be frozen when the fuel is within the pipeline;

III) Using Hybrids Involving Both Chilled and Frozen Fuel:

A) of I) and II) above, in which some segments of the pipeline carry frozen fuel and other segments carry chilled fuel;

B) in which some segments of the pipeline carry non-chilled fuel, and others carry chilled fuel;

C) in which some segments of the pipeline carry non-chilled fuel, and others frozen fuel; and D) in which some segments of the pipeline carry non-chilled fuel, others carry chilled fuel, and still others carry fuel which is neither chilled nor frozen.

In a preferred embodiment of the invention, the hybrid approach would use the coldest fuel for the highest risk pipeline segments, and less cold fuel for lower risk segments. Embodiments of the invention with one, two, three, four or more fuel temperatures, each in a different segment of the pipeline, are possible. High risk segments might be defined as the most vulnerable pipeline segments, either because they are above the ground surface, near the surface, or in areas which are difficult to patrol/observe.

Storage Facilities

Similar protective methods for storing and handling fuel in a storage facility or depot to decrease the risk of fire, explosion, detonation, ignition or leakage—whether accidental or intentional—parallel the approach to pipeline protection.

The depot consists of one or more storage tanks. The tanks may be:

I) above ground;

II) below ground; or

III) some above and some below ground.

The depot may contain frozen fuel, chilled fuel or hybrid situations, as described above for pipelines. A depot may contain mixtures of chilled and frozen fuel such that:

I) Some tanks are at one temperature, and one or more other tanks are each at another temperature; and II) There may be more than one fuel temperature in different regions of the same tank.

Tanks may be filled by either:

I) filling the tank with chilled fuel, and freezing the fuel after it is contained within the tank;

II) first freezing the fuel in smaller parcels (sticks, etc.), and then stacking sticks (or another shape which wastes only small amounts of space) in a large common storage chamber;

III) filling the tank with chilled fuel, and maintaining the fuel in a chilled state within the tank.

If the depot contains fuel which is below the pour point, and in particular if it contains fuel which is substantially or completely solid, it will need to contain means for moving that non-liquid fuel from the depot into the pipeline. Examples of such means (e.g. shaving pieces off of a rectangular solid) parallel the discussion of loading frozen fuel onto an aircraft, or moving it on the aircraft as discussed in U.S. Pat. No. 7,222,821.

The Storage Depot/Pipeline Interface

If the state of the fuel in the pipeline is to differ from that of the depot, means will be required to convert the depot fuel to pipeline fuel. For example, if the depot is to contain frozen fuel and the pipeline is to contain chilled liquid fuel, then melting means will need to be placed at the junction between the depot and the pipeline. Similarly, if the depot is to contain chilled liquid fuel and the pipeline is to contain frozen fuel, then freezing means will need to be placed at the junction between the depot and the pipeline.

Since the majority of pipeline and depot protection apparatus and methods are conceptually similar, hereinbelow, the word "pipeline" is intended to refer to each of A) an actual pipeline and B) a storage depot. In instances where a distinction needs to be made between pipelines and depots (or between pipelines and tanks), the terms "actual pipeline" will be used.

Pipeline Construction Issues:

I) The pipeline may have 2 or more layers of skin to minimize

A) fuel leakage;

B) accidental damage to pipeline; and

C) intentional damage to pipeline.

II) The pipeline may be monitored by placing temperature sensors between each layer of pipeline skin (see figure and see specification hereinbelow), as well as sensors within the pipeline and external to the pipeline.

III) The pipeline may contain outer insulation or a "thermos-like" outer layer to minimize cold temperature loss;

IV) "Firewall valves" may be placed:

A) between segments of an actual pipeline;

B) between a storage tank and an actual pipeline; and

C) between tanks (though conceptually this is largely similar to A) immediately above, since the likelihood is that two tanks would be connected by an actual pipeline).

Firewall valves may be placed along a fuel route to minimize the chance of widespread pipeline destruction, in the event of a terrorist or accidental fire.

In the event of a fire/explosion involving an actual pipeline, the valve on each side of the fire/explosion would be closed. Furthermore, fuel may be evacuated from the pipeline segments adjacent to the fire/explosion by pumping/moving the downstream fuel further downstream, and by pumping/moving the upstream fuel further upstream.

In the event of a fire/explosion involving a tank, the valve which lets fuel out of the tank would be closed. Furthermore, fuel may be evacuated from the pipeline segment(s) adjacent to the involved tank by pumping/moving the downstream fuel further downstream.

Fuel Transport Issues:

Possible transport methodologies for frozen fuel include:

I) freezing it into rectangular sticks (like sticks of butter), and moving it on a continuously moving conveyor belt (or series of such belts)

II) the same as I) above but moving the sticks on rollers

III) the same as I) above but placing the sticks in "railroad car"-like apparatuses A) wherein each one has an engine to propel it B) wherein one engine pulls (or pushes or both) many such cars C) wherein the cars are moved by rotating wheels within the pipeline D) wherein the cars are moved by alternating magnetic fields, including a variant where the apparatus is like a "mag-lev" train.

IV) putting the fuel into round objects with holes (size may range from be-be's to volley balls), and then freezing the fuel in the round objects. The principle is that the fuel-containing objects can roll through the pipeline. They may be propelled either A) magnetically;

B) by a pushing device;

C) by gravity, 1) in a downhill section of actual pipeline; or 2) when moving from a tank to an actual pipeline, when the center of gravity of the fuel within the tank is above the level of the actual pipeline.

Emergency Apparatus and Method for Rapidly Lowering the Temperature of a Jeopardized Pipeline:

In order to further protect a pipeline which is threatened, damaged or attacked, further cooling of the fuel within it, on a rapid basis, may be advantageous. This may be accomplished by having a source of cold temperature substance either within it, or immediately adjacent to it.

Examples of the cold substance are:

I) frozen fuel (in the case of a pipeline containing chilled liquid fuel);

II) dry ice (i.e. frozen carbon dioxide) (in the case of a pipeline containing chilled liquid fuel); and III) a very cold liquid (e.g. liquid nitrogen, or another liquid which is chemically highly stable, such as a liquefied form of a noble element) in the case of a pipeline carrying either a solid or liquid fuel.

The substance may be stored:

I) within the pipeline; or

II) outside of the pipeline (but in its vicinity).

Pipeline Monitoring:

The monitoring may be:

I) automatic, i.e. by microprocessors within or in the vicinity of the pipeline;

II) by humans, either in the vicinity of the pipeline, or remotely located; and

III) by combinations of I) and II), immediately above.

The monitoring may be used to:

I) control the flow of fuel under non-emergency conditions;

II) detect pipeline damage;

III) divert fuel during emergency conditions; and

IV) activate the emergency apparatus for rapidly lowering temperature during an emergency.

Referring to the figures:

FIG. 1 shows a segment of a pipeline 10. Fuel would be contained in the space 12 within the pipeline. (Although the contents of the figure resembles a segment of actual pipeline, nothing contained within the figure or the discussion of the figure is inconsistent with or inapplicable to the case of 10 also constituting the walls of a fuel storage tank, and 12 being the space within the tank.)

The pipeline has an inner layer 9 and an outer layer 11. The space between the inner and outer layers may contain:

I) insulating material (which may be solid, liquid, gas, or a mixture of these);

II) may consist of the same material of one or more of 9 or 11; or

III) may be a vacuum, or a highly evacuated region with "near vacuum" conditions.

14 is a temperature sensor outside of the pipeline, or at its outer edge. 16 is a temperature sensor situated between the inner and the outer pipeline walls. 18 is a temperature sensor inside of the fuel containing segment of the pipeline. Though only one each of 14, 16 and 18 are shown in the figure, it is to be understood that such elements may be placed at intervals axially (rightwards or leftwards in the figure) and radially (in the figure, e.g., associated with the pipeline wall segment "below" that containing 14, 16 and 18 [i.e. in the segment between elements 22]). In the case of a tank, they may be anywhere along its walls.

14, 16 and 18 could also be pressure sensors. Alternatively 14, 16 and 18 could represent a mixture of temperature, pressure and possibly other sensors. (The other sensors could include chemical detectors for either the fuel or for whatever substance is surrounded by 11.)

20 represents equipment which receives information from sensors 14, 16 and 18. It includes a microprocessor. The information can be used to control refrigeration elements 22 directly. In an alternative embodiment, 20 sends a signal to a remote station, not shown. A person, a computer, a bank of computers, a microprocessor, multiple microprocessors or a combination of the aforementioned at the remote station then receives the signal, analyzes/processes it, and sends a return signal which is used to control 22.

The figure shows no hardwire connections between the sensors and 20, and shows no such connections between 20 and 22. The connections could be using conventional wireless technology, as is known in the art, or could be hardwired, as is shown in reference to FIG. 2 (see below), or could be a mixture of hardwired and wireless.

The pipeline may contain one or more additional concentric layers (e.g. one or more layers outside of 11). In the case of one additional layer, for example, the result would be the creation of a space between 11 and the additional outer layer. This space could have the same or different properties as the space between 9 and 11. 14 could, in this exemplary case be considered a sensor within the space defined by 11 and the outer layer. Additional sensors analogous to 14 and 16 could be placed to monitor the outer layer.

Figure 2:
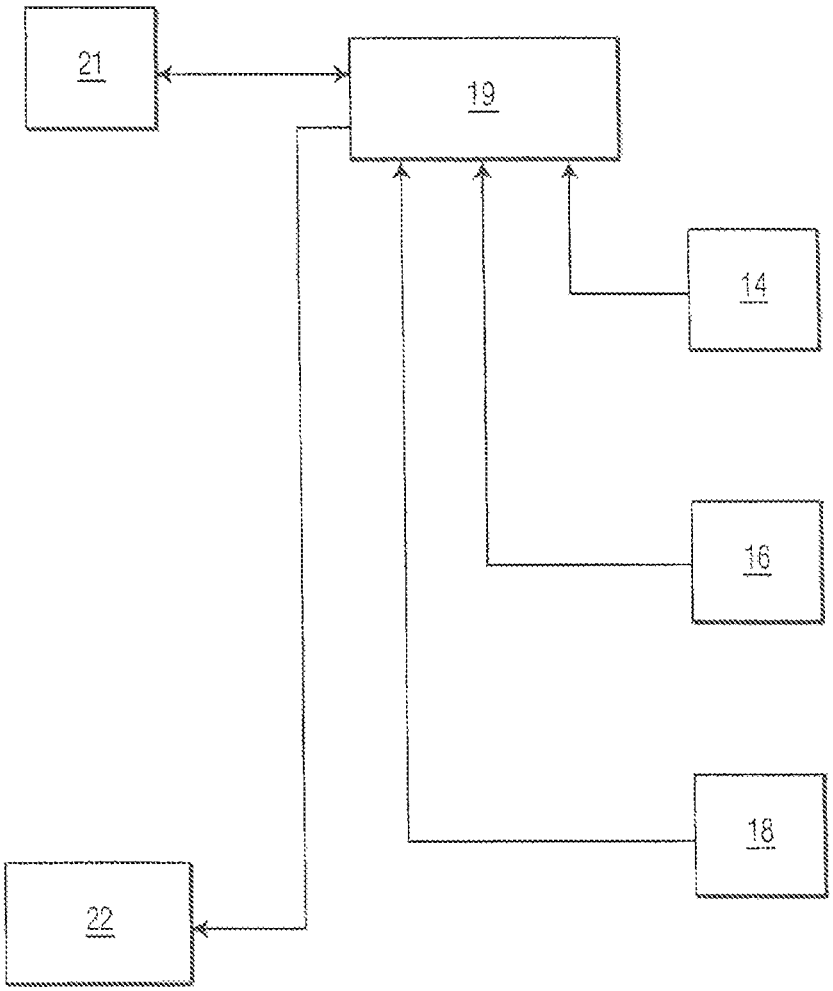
FIG. 2 is a schematic block diagram showing an embodiment of the control apparatus for the cooling apparatus of FIG. 1.

FIG. 2 shows an embodiment of the invention in which the pipeline monitoring apparatus is connected by hardwire connections. Element 20 of FIG. 1 is replaced in FIG. 2 by elements 19 (a microprocessor plus interface apparatus [as is known in the art] to render 19 able to exchange signals with 21 and 22) and 21 (a transmitter/receiver device). In an alternate embodiment of the invention, one or more of the connections between 19 and the remote station may be hardwired. Embodiments of the invention are possible in which:

I) multiple 14*s*, 16*s* and 18*s* connect to each 19;

II) multiple 19*s* connect to a single 21; and multiple 22*s* are controlled by a single 19.

Many other alternate embodiments, where the alternations involve the number of connections between the types of elements shown in FIG. 2, will be obvious to those skilled in the art.

Figure 3A:
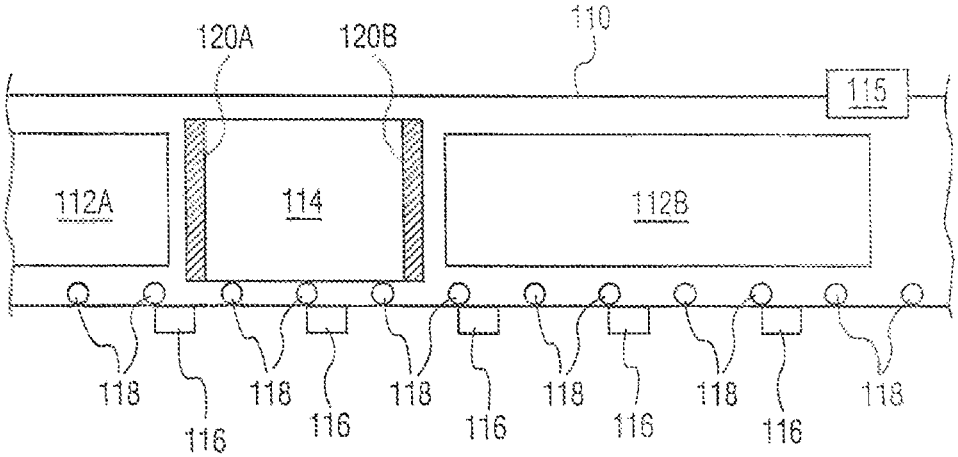
FIG. 3A is a representational diagram of a pipeline for moving units of a frozen hazardous substance, showing apparatus disposed between the frozen units, which causes the movement of the units within the pipeline.

FIG. 3A shows an embodiment of the invention in which portions of fuel 112A and 112B are pushed through actual pipeline 110. In the figure, fuel movement is from left to right, and pushing apparatus 114 pushes fuel element 112B. Cooling apparatus 115 is provided to keep the contents of the pipeline cold.

112A and 112B (referred to collectively as 112) may be:

I) a block of solid fuel;

II) a container which contains solid fuel; or

III) a container which contains liquid fuel.

Figure 3B:
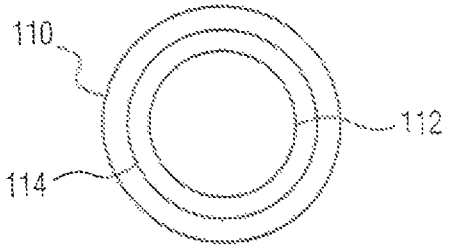
FIG. 3B is another representational diagram of a pipeline similar to that shown in FIG. 3A.

The movement of 112 is passive, i.e. in response to pushing element 114. 112 may shaped as a rectangular block, or, as shown in FIG. 3B, which is a cross sectional view of the same apparatus as is shown in FIG. 3A, or 112 may be cylindrical.

114 may push 112B:

I) with an energy supply contained within 114 (and replenished from time to time);

II) with an energy supply external to 114, e.g.

A) by rotating elements 118 (rotating clockwise when viewed above the plane of the paper);

B) by an externally applied varying magnetic field (as is known in the art—e.g. so-called "mag-lev" trains) such as may be supplied by elements 116; or C) by energy transfer to 114, e.g. by electromagnetic induction or radiofrequency means, with elements 116 serving as the source of such energy.

In embodiments of the invention with a self-contained power source within 114, elements 116 may be unnecessary. In embodiments of the invention with magnetic levitation, elements 118 may be unnecessary. Numerous other methods of pushing fuel containing elements 112 will be obvious to those skilled in the art.

Embodiments of the invention in which 114 pushes 112B for long distances or even for the length of the actual pipeline are possible. In an alternate embodiment of the invention, 114 is larger than 112, and contains collapsible elements 120A and 120B (collectively referred to as 120). The collapse of 120 allows 114 to slide over 112. In such an embodiment, I) 114 may (with 120 non-collapsed) push 112B along a segment of actual pipeline (left to right in the figure);

II) Simultaneous with I), an element similar to 114 pushes 112A from left to right;

III) Then 120 collapses, allowing 114 to move from right to left, over 112A, thereby to return to the position occupied by 114 at the start of I) above.

The process of I) II), III) then repeats.

In an alternative embodiment, 114 may be a pulling device, which pulls 112A, instead of pushing 112B. The discussion hereinabove about the functional possibilities of 114 (in terms of power source and in terms of continuous or cyclical motion) are identical for the "pulling" as for the pushing case.

In yet another alternative embodiment, 114 may serve the dual purpose of both pushing 112B and pulling 112A. Again, the above details apply.

The collapse of 120 may be analogous to the opening of an iris in a camera lens. Other means of achieving the collapse of 120 will be obvious to those skilled in the art. In yet another alternative embodiment, 114 may collapse in a way which allows it to intermittently pass adjacent to 112A, moving in the direction opposite to that of 112A.

FIG. 3B shows a cross sectional view of the actual pipeline shown in FIG. 3A. Although the figure shows an example with a circular cross section, embodiments of the invention with non-circular cross sections are possible. The figure shows an example in which 114 is capable of sliding over 112, so that 114 motion may be cyclical, as discussed hereinabove.

Figure 3C:
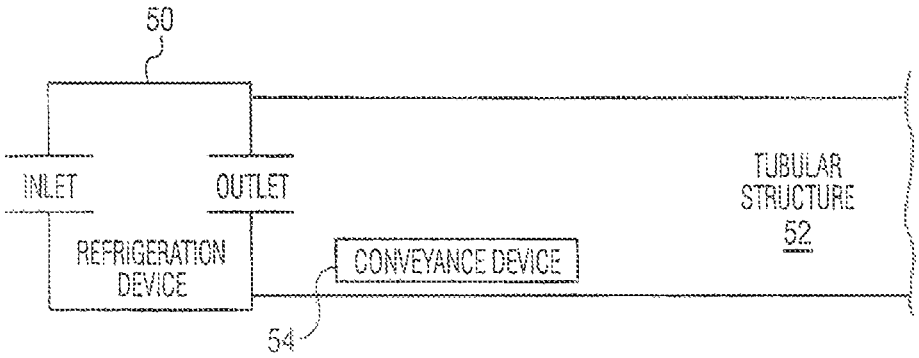
FIG. 3C is a representational diagram of a tubular structure with a refrigeration unit and a conveyance device for cooling and conveying a hazardous substance.

FIG. 3C shows apparatus which could be used to supply the apparatus of FIG. 3A with frozen fuel. A tubular structure 52, which for example may be circular, square, rectangular or triangular in cross-section, is provided with a refrigeration device 50. The refrigeration device receives liquid fuel at its inlet and passes frozen fuel out its outlet to the inlet end of the tubular structure. A conveyance device 54 is provided within the tubular structure to convey the frozen fuel from left to right (in the sense of the drawing), to the outlet end of the structure.

Figure 4:
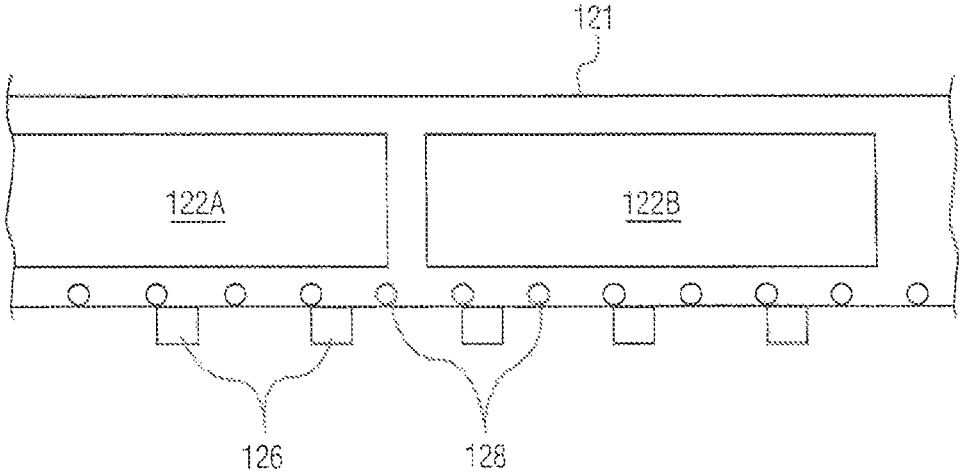
FIG. 4 is a representational diagram of a pipeline for moving units of a frozen hazardous substance, showing alternative embodiments of apparatus which causes the movement of the frozen units within the pipeline.

FIG. 4 shows an actual pipeline example in which fuel elements 122A and 122B (collectively referred to as 122) are not separated by a pushing and or pulling element analogous to 114. Among the possibilities for such an approach are embodiments in which:

I) apparatus with pushing and/or pulling capability (and the energy source for the motion is contained within 122; and 122 consists of a vehicle which both contains the fuel and contains apparatus for moving the vehicle;

II) apparatus with pushing and/or pulling capability (which depends on an externally supplied energy source for the motion) is contained within 122; and 122 consists of a vehicle which both contains the fuel and contains apparatus for moving the vehicle; and III) apparatus in which each of 128 rotates, and thereby propels 122, i.e. by friction between 128 and 122. (Each similarly shaped circular element in the figure is considered 128.)

Elements 126 (Each similarly shaped square element in the figure is considered 126.) in FIG. 4 are analogous to 116 in FIG. 3A, i.e. a source of external energy for either the rotation of elements 128, for the movement generating apparatus within 122, or both.

Figure 5A:
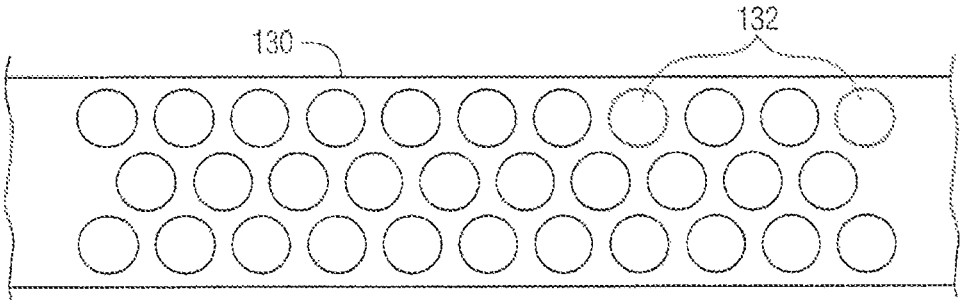
FIG. 5A is a representational diagram of a pipeline for carrying substantially spherical elements, each of which contains a frozen hazardous substance.

FIG. 5A shows actual pipeline 130 containing spherical elements 132. Each similarly shaped round element in the figure is considered 132. 132 would contain the fuel, encased in an apparatus with a relatively low coefficient of friction, such that it can roll through actual pipeline 130. As indicated hereinabove, the fuel containing balls may be propelled either:

A) magnetically;

B) by a pushing device; or

C) by gravity. Furthermore, as indicated hereinabove, this propulsion system may apply to actual pipelines and to fuel moving from a tank to a pipeline. Indeed the concepts embodied by the propulsion systems shown in FIGS. 3A and 4 could also be applied to fuel exiting a tank and entering an actual pipeline, or to fuel moving within a tank. In these cases, the geometric constraint implied by the structure of 110, 121 and 130 would be altered, due to a less constrained tank structure.

Figure 5B:
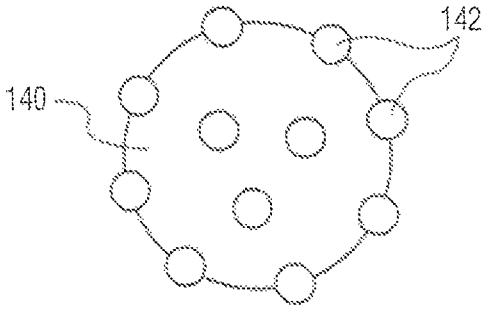
FIG. 5B is a representational diagram showing a detailed view of one of the substantially spherical elements shown in FIG. 5A.

FIG. 5B shows an example of a hollow ball 140 with holes 142 which allow fuel ingress and egress. Each similarly shaped small round element in the figure is considered 142. The storage process is as follows:

1) Fuel in the liquid state passes into the core of 140 through holes 142.

2) The temperature is then lowered, causing the solidification of the fuel within 140.

3) 140 is then moved, taking advantage of its rounded outer contour. (Holes 142 do not project outside of the spherical exterior of 140; That they appear to in the figure is simply a case of artistic license.)

4) When fuel-containing 140 reaches its destination, the temperature is raised, the fuel melts, and flows out of 140.

Figure 6:
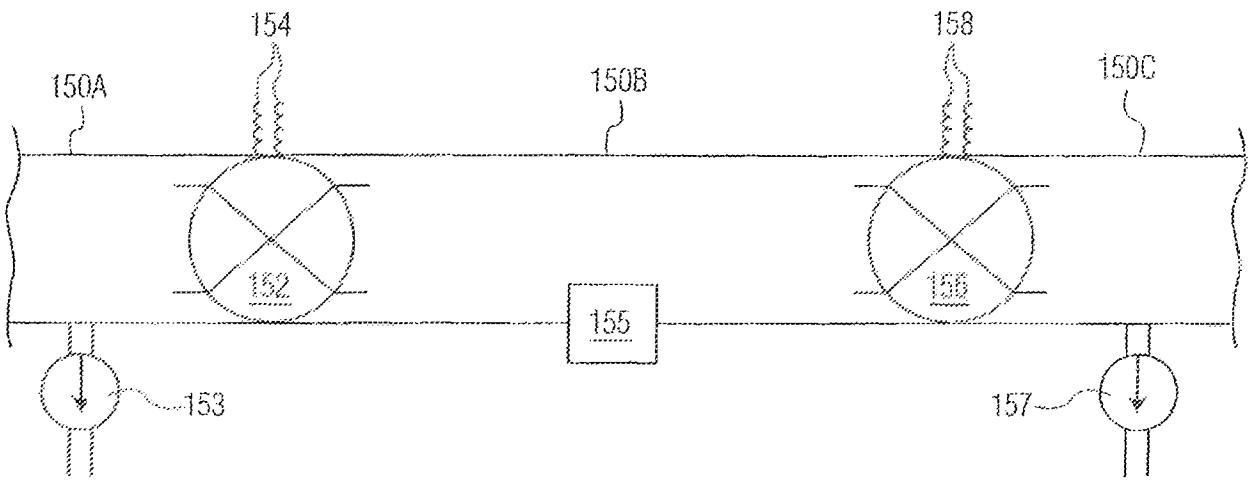
FIG. 6 is a representational diagram of a pipeline containing valves which may be used to isolate a compromised segment of a pipeline.

FIG. 6 shows an example of two valves 152 and 156 within actual pipeline 150 (consisting of elements 150A, 150B and 150C); The purpose of the valves is containment of a problem within actual pipeline segment 150B. During ordinary pipeline operation (i.e. no threat or problem), valves 152 and 156 are open, allowing the passage of a hazardous substance, e.g. a fuel, from 150A to 150B to 150C. In the event of threat or problem involving segment 150B, both valves are closed, in an attempt to restrict the problem to segment 150B. In a preferred embodiment of the invention, a valve closure signal is sent electronically to valve 152 via wires 154, and to valve 156 via wires 158. The source of the signal is the monitoring and control apparatus shown in FIGS. 1 and 2. In the automatic case, microprocessor 20 (via interface apparatus) would signal 152 and 156 to close. In the case where an external person or apparatus is in control, the valve closure signal would be received by 21, and be sent from 19 to 152 and 156.

As indicated hereinabove, additional protection results by pumping/moving fuel away from the problem segment:

Pump 153 may pump the fuel out of segment 150A;

Pump 157 may pump the fuel out of segment 150C.

An "all clear" signal, sent out if the problem situation which caused valve closure had resolved, could later be sent to open 152 and 156 in a procedure analogous to that of their closure.

Cooling apparatus 155 is provided to cool the contents of the pipeline.

Figure 7A:
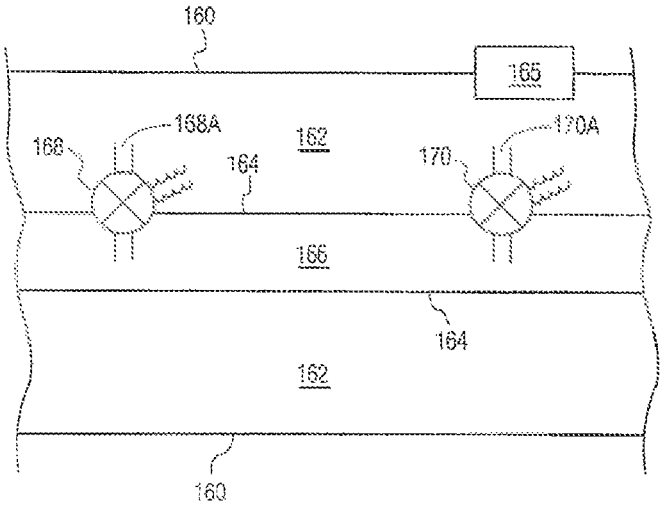
FIG. 7A is a representational diagram of a pipeline or storage facility for a hazardous fluid, containing apparatus for rapidly cooling the hazardous fluid, if necessary.

FIG. 7A shows an apparatus for rapidly cooling the fuel 162 within pipeline 160. 160 contains additional pipeline or cooling tube 164 (which therefore may be a) an actual pipeline within an actual pipeline, b) an actual pipeline within a tank, c) a tank within a tank, or d) a tank within an actual pipeline. 164 contains cold liquid or solid 166 as described hereinabove. In the event of threat or disaster, valves 168 and 170 are caused to open, allowing 166 to mix with 162 via injectors 168A and 170A. In the embodiment in which 166 is a solid, means for moving 166 out of 164 and into the fuel-containing space of 160 would improve operation of the invention. The valves are controlled as described in conjunction with FIG. 6 hereinabove.

Figure 7B:
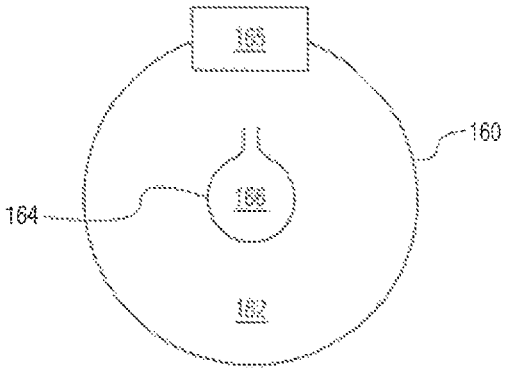
FIG. 7B is another representational diagram of the apparatus shown in FIG. 7A, which is orthogonal to the view shown in FIG. 7A.

FIG. 7B shows a cross sectional view of the apparatus shown in FIG. 7A. In both FIGS. 7A and 7B, the pipeline 160 is shown as having a refrigeration unit 165 to cool its contents 162. Although a circular configuration for each of 160 and 164 are shown, neither need be circular. Furthermore, the position of 164 within 160 need not be central; off-center locations are possible, including locations at or near the outer wall of 160. In an alternative embodiment of the invention, locations in which 164 is outside of 160, are possible; In such instances, passageways analogous to 168A and 170A allowing the movement of coolant 166 into the interior of 160 would be necessary.

There is thus described herein a method of reducing the risk of accidental or intentional widespread pipeline damage, for fuel containing pipelines (including actual pipelines and tanks).

The apparatus and methods described herein would also be usable in situations for pipelines which contain:

I) a gaseous fuel (in which case causing the fuel to change state to either a liquid or a solid could increase the safety of transport);

II) a hazardous chemical in gaseous state (in which case causing the chemical to change state to either a liquid or a solid could increase the safety of transport);

III) a hazardous chemical in liquid state (in which case causing the chemical to change state to a solid could increase the safety of transport);

IV) a radiation emitting substance in gaseous state (in which case causing the substance to change state to either a liquid or a solid could increase the safety of transport); and V) a radiation emitting substance in liquid state (in which case causing the substance to change state to a solid could increase the safety of transport).

Numerous variations in the apparatus and methods of fuel transport within an actual pipeline and within a tank or between tanks, of pipeline construction, of pipeline monitoring and of pipeline management during an emergency—each based on the fundamental principles presented herein—will be obvious to those skilled in the art.

What is claimed is:

1. A method of managing a hazardous fluid in a pipeline, the method comprising:

(a) providing:

(i) a first hollow pipeline element having:

(A) an inlet end and an outlet end;

(B) a first valve, disposed at the inlet end, controlling the entry of fluid into the first element;

a second valve, disposed at the outlet end, for controlling the exit of fluid from the first element; and (ii) a second hollow pipeline element, having (A) an inlet end coupled to the outlet end of the first element and located downstream from the first element, and having an outlet end, and (B) a downstream pump, coupled to the second element;

(b) detecting, by a sensor, an enhanced likelihood of escape of a hazardous fluid from the first element, the enhanced likelihood exceeding a threshold value;

(c) upon the detection, providing, by the sensor, a signal representing enhanced likelihood to a control device;

(d) receiving, by the control device, the signal;

(e) upon receiving the signal, providing, by the control device, a closing signal to at least one of the first valve and the second valve wherein the closing signal represents a command to close the respective valve;

(f) upon closing the at least one valve, activating, by the control device, the downstream pump; and (g) pumping the hazardous fluid downstream by the pump.

2. The method of claim 1 further comprising cooling the hazardous fluid by a cooling apparatus.

3. The method of claim 1, wherein said step (g) comprises draining the second element by the downstream pump.

4. The method of claim 1, wherein the first element comprises a storage tank.

5. The method of claim 1, wherein the first element comprises an actual pipeline.

6. A method of managing a hazardous fluid in a pipeline, the method comprising:

(a) providing:

(i) a first hollow pipeline element having:

(A) an inlet end and an outlet end;

(B) a first valve, disposed at the inlet end, for controlling the entry of fluid into the first element;

(C) a second valve, disposed at the outlet end, for controlling the exit of fluid from the first element; and (ii) an additional hollow pipeline element, having (A) an outlet end coupled to the inlet end of the first element and located upstream from the first element, and having an inlet end, and (B) an upstream pump, coupled to the additional element;

(b) detecting, by a sensor, an enhanced likelihood of escape of a hazardous fluid from the first element, the enhanced likelihood exceeding a threshold value;

(c) upon the detection, providing, by the sensor, a signal representing the enhanced likelihood to a control device;

(d) receiving, by the control device, the signal;

(e) upon receiving the signal, providing, by the control device, a closing signal to at least one of the first valve and the second valve wherein the closing signal represents a command to close the respective valve;

(f) upon closing the at least one valve, activating, by the control device the upstream pump; and (g) pumping the hazardous fluid upstream by the pump.

7. The method of claim 6 further comprising cooling the hazardous fluid by a cooling apparatus.

8. The method of claim 6, wherein said step (g) comprises draining the additional element by the upstream pump.

9. The method of claim 6, wherein the first element comprises a storage tank.

10. The method of claim 6, wherein the first element comprises an actual pipeline.

11. A method of managing a hazardous fluid in a pipeline, the method comprising:

(a) providing:

(i) a pipeline having an inlet end and an outlet end; and having a hollow interior region, bounded by a pipeline wall, said wall having an inner and an outer surface;

(ii) a plurality of sensors, arranged along the pipeline, including at least one chemical sensor operative to sense the presence of at least one specific chemical structure, to determine when a degree of likelihood that the hazardous fluid will escape from the pipeline exceeds a given level; and (iii) a plurality of injectors, arranged between the inlet and the outlet end for injecting a cooling fluid into the pipeline;

(b) detecting, by at least one said of the sensors, including the at least one chemical sensor, a degree of likelihood of escape of the hazardous fluid from the pipeline exceeding a given level;

(c) upon the detection of said excessive likelihood, providing, by the sensor, a signal representing the detection of said excessive likelihood, to a control device;

(d) upon receiving, the signal, providing, by the control device, an injection signal to at least one of said injectors to inject said cooling fluid; and (e) upon receiving of the injection signal, injecting, said cooling fluid, by at least one of said injectors.

12. The method of claim 11, further comprising cooling the hazardous fluid by a cooling apparatus.

13. The method of claim 11, wherein said step (b) further comprises detecting, by a temperature sensor, the degree of likelihood, and wherein said step (c) further comprises providing a signal representing said degree of likelihood to the control device.

14. The method of claim 11, wherein said step (b) further comprises detecting, by a pressure sensor, the degree of likelihood, and wherein said step (c) further comprises providing a signal representing said degree of likelihood to the control device.

15. The method of in claim 11, wherein said step (a) includes locating at least one of said plurality of sensors within said hollow interior region.

16. The method of claim 11, wherein said step (a) includes locating at least one of said plural of sensors exterior to said hollow pipeline.

17. The method of claim 11, wherein said step (a) includes locating, at least one of said plurality of sensors thin said pipeline wall, between said interior surface and said exterior surface.

18. The method of claim 11, wherein the pipeline comprises an actual pipeline.

19. The method of claim 11, wherein the pipeline comprises a storage tank.

* * * * *